US009027898B1

(12) United States Patent
Holmboe

(10) Patent No.: US 9,027,898 B1
(45) Date of Patent: May 12, 2015

(54) SHORING APPARATUS WITH ROLLER BEARING

(76) Inventor: Brent Holmboe, Nichols Hills, OK (US)

( * ) Notice: Subject to any disclaimer, the term of this patent is extended or adjusted under 35 U.S.C. 154(b) by 171 days.

(21) Appl. No.: 13/559,865

(22) Filed: Jul. 27, 2012

(51) Int. Cl.
*F16M 11/00* (2006.01)
*E04G 21/26* (2006.01)

(52) U.S. Cl.
CPC ..... *E04G 21/26* (2013.01)

(58) Field of Classification Search
CPC ..... E04G 21/26; E04D 15/00
USPC ..... 248/161, 157, 410, 411, 405, 406.1; 52/126.1, 126.6, 126.7
See application file for complete search history.

(56) References Cited

U.S. PATENT DOCUMENTS

| | | | | |
|---|---|---|---|---|
| 3,797,793 | A * | 3/1974 | Moritz et al. | 248/295.11 |
| 4,067,543 | A | 1/1978 | Orth et al. | |
| 4,831,797 | A * | 5/1989 | Vladikovic | 52/126.6 |
| 5,000,416 | A | 3/1991 | Fantasia | |
| 5,031,869 | A * | 7/1991 | Strater et al. | 248/406.1 |
| 6,941,708 | B2 * | 9/2005 | McCracken et al. | 52/126.1 |
| 7,165,361 | B2 * | 1/2007 | Vanagan | 52/126.6 |

* cited by examiner

*Primary Examiner* — Amy Sterling
(74) *Attorney, Agent, or Firm* — Global IP, PLLC; Esther Roberts Bell

(57) ABSTRACT

The present general inventive concept teaches a shoring apparatus with roller bearing to facilitate ease of use and inhibit undue wear on the apparatus. The apparatus is expandable and retractable and is releasably secured via a tightening assembly. In some embodiments, the tightening assembly includes a nut, at least one flat washer, a roller bearing, at least two split rings, and a rotator. The tightening assembly—featuring the roller bearing—serves to decrease friction, increase safety, and enhance both ease of positioning and ease of stabilization with respect to the shoring apparatus.

6 Claims, 7 Drawing Sheets

SHORING APPARATUS WITH ROLLER BEARING

CROSS-REFERENCE TO RELATED APPLICATIONS

Not Applicable.

STATEMENT REGARDING FEDERALLY-SPONSORED RESEARCH OR DEVELOPMENT

Not Applicable.

BACKGROUND OF THE INVENTION

Shoring apparatus, such as screw jacks, steel shores, and the like, have long been utilized as both temporary and permanent weight-bearing support structures. Some examples of such uses include new construction, both commercial and residential, where such apparatus may be used to support additional levels as the structure is raised, and reconstruction, where such apparatus may be used to provide support, e.g., to shore up a sagging ceiling or floor when the support joists have been compromised. Other traditional uses for shoring apparatus include search and rescue operations, mining and excavation, support for form structures utilized in pouring concrete or other cement-type materials, and similar applications.

Typically, shoring apparatus include, at a minimum, a base, a core rod, and a tightening mechanism or assembly, with the core rod designed so as to provide adjustability to the length of the apparatus. Many times, the core rod's exterior is threaded in order to provide precision with respect to this adjustability. Due to the core rod being threaded to enable precision relative to raising and lowering the apparatus, incrementally extending or retracting the core, as well as tightening and loosening the core relative to the base, these apparatus can sometimes be difficult to use. This is because the tightening assembly—which typically includes a nut of some type, such as, for some examples, wing nuts, hex nuts, and capstan nuts—can get jammed, cross-threaded, or similarly malfunction. In other instances, particularly in situations where the device is in use and thus bearing weight, the threaded core and tightening assembly respond to the resultant weight-induced compression by being extremely difficult to loosen. In addition, over time, friction and wear can cause the threading to become worn to the point of slippage and resulting shoring apparatus failure. Because of these issues, a need in the art exists for an enhanced design for a shoring apparatus that minimizes friction, reduces wear, increases safety, and enhances the utility of the apparatus.

BRIEF SUMMARY OF THE INVENTION

Example embodiments of the present general inventive concept provide a shoring apparatus with roller bearing to facilitate ease of use, enhance safety, and minimize friction, and reduce undue wear on the apparatus. The apparatus is expandable and retractable and is releasably secured via a tightening assembly. In some embodiments, the tightening assembly can include a nut, such as a wing nut, hex nut, or capstan nut. In some embodiments, the tightening assembly can include a nut, at least two flat washers, a roller bearing, at least two split rings, and a rotator. The tightening assembly, in some embodiments, features a nut with a recessed interior sufficient to allow insertion of one flat washer, a roller bearing, another flat washer, and a rotator. In some embodiments, the rotator can have a recessed midsection; in such embodiments, this recessed midsection can accommodate a pair of split rings, inserted so as to form a circle around the recessed midsection of the rotator. In these embodiments, the split rings serve as a circular platform upon which the rotator can both rest and rotate freely within the horizontal plane around the core and the base as may be required. In some embodiments, the present general inventive concept is constructed of metal or a metal composite, such as, for one example, steel. In some embodiments, galvanization may be utilized to provide optimal surface protection of the apparatus and components thereof. Other embodiments can feature the present general inventive concept constructed of, as some examples, plastic, polymer, wood, composite material, or other material.

Briefly, the present general inventive concept provides a shoring apparatus with roller bearing to facilitate ease of use, enhance safety, and minimize friction, and reduce undue wear on the apparatus. The apparatus is expandable and retractable and is releasably secured via a tightening assembly.

The shoring apparatus can include, in some embodiments, a base that is of a circular rod shape including therewithin a void for receiving a core rod, a core rod, and a tightening assembly for expansion and retraction of the core within the base. In some embodiments, the base can include an optional base plate which, in some embodiments, has a means of attachment defined therein, such as holes through-bored in each corner of the base plate to provide for attaching the base plate to a structure.

In some embodiments, the core rod can be defined to have threading upon the exterior surface of the rod, thus enabling precise adjustment of the shore apparatus with respect to length via a tightening assembly that can be complementarily threaded so as to provide close-tolerance threading of the tightening assembly upon the core, thereby allowing the core to be releasably secured relative to the base. In some embodiments, the core can be through-bored near one end and have an optional top plate assembly, which can include a top plate, a collar fixedly attached to the top plate and having defined within the collar at least two holes to provide for attachment to the core, and a pin—such as, for one example, a clevis pin with an optional washer and a cotter pin to secure the clevis pin included—for through attachment of the top plate assembly to the core.

The shoring apparatus can also include, in some embodiments, a tightening assembly which can include a nut—such as, for some examples, a wing, hex, or capstan nut—and a roller bearing for reduction of friction between the base, the core and the nut. In some embodiments, the nut can have defined therein a recess so as to provide a semi-enclosed, walled shelf to serve as a resting surface for the remainder of the tightening assembly. In some embodiments, the tightening assembly can also include a pair of flat washers, placed one above and one below the roller bearing, to enhance the reduction of friction and wear on the roller bearing and the assembly as a whole. In some embodiments, the tightening assembly can also include a rotator and, optionally, at least two split rings. The rotator can facilitate temporary stationary positioning of the core and the tightening assembly relative to the base. In some embodiments, the rotator can be defined to have an upper end, a midsection and a lower end. In certain exemplary embodiments, the upper end of the rotator is defined to be of a complementary diameter to the diameter of the recess within the nut so as to provide a close-tolerance fit of the upper end of the rotator within the nut recess. In some embodiments, the rotator midsection is defined to create a recess within the rotator, for the purpose of creating a channel into which the at least two split rings can fit. In some embodiments, the at least two split rings serve to provide a platform for fixed attachment to the at least one nut; in these embodiments, the nut and split rings being fixedly attached together allows for the rotator and roller bearing, and any optional flat washers, to "float" freely within the recess of the nut, while simultaneously securing the various parts of the tightening assembly into one unit which will remain intact even if completely removed from the core and/or the base. In some embodiments, the lower end of the rotator is defined to include a recess, the recess to be in complementary diameter with the base so as to allow the lower end of the rotator to sit on top of the base rod; in these embodiments, the base can be fixedly attached to the rotator rim via, in some instances, welding. When the apparatus is in use, any pressure placed upon the apparatus is appropriately transmitted between the core and the base by the rotator recess, and fixed attachment between the base and the rotator, with minimal pressure or stress placed upon the tightening assembly. Further, the roller bearing, whether with or without a flat washer above and/or below the bearing, serves to relieve and reduce friction within the tightening assembly and, concurrently, friction and wear are reduced within and upon the overall apparatus. The roller bearing also provides for ease of manipulation of the tightening assembly while simultaneously enhancing safety, because the likelihood of injuries such as hand or digit injuries is lowered due to the increased ease of manipulation of the tightening assembly.

An optional locking feature can be included in the tightening assembly. In some embodiments, this locking feature can include a hole through-bored through the nut, so as to allow insertion of a set screw to lock the tightening assembly into place relative to the core. Unlocking is achieved by reverse turning the set screw.

Additional features and embodiments of the present general inventive concept will be set forth in part in the description which follows and, in part, will be obvious from the description, or may be learned by practice of the present general inventive concept.

BRIEF DESCRIPTION OF THE DRAWINGS

The above-mentioned and additional features of the invention will become more clearly understood from the following detailed description of the invention read together with the drawings in which.

DETAILED DESCRIPTION OF THE INVENTION

The following detailed description may recite various descriptive terms such as horizontal, vertical, top, bottom, upward, downward, left, right, etc., when referring to the exemplary figures, but the present general inventive concept is not limited to any such terms or physical orientations. Such terms are used for convenience of description only, and could be reversed, modified, or interchanged without departing from the broader scope and spirit of the present general inventive concept.

Example embodiments of the present general inventive concept provide a shoring apparatus with roller bearing to facilitate ease of use, enhance safety, and minimize friction, and reduce undue wear on the apparatus. The apparatus is expandable and retractable and is releasably secured via a tightening assembly.

Figure 1:
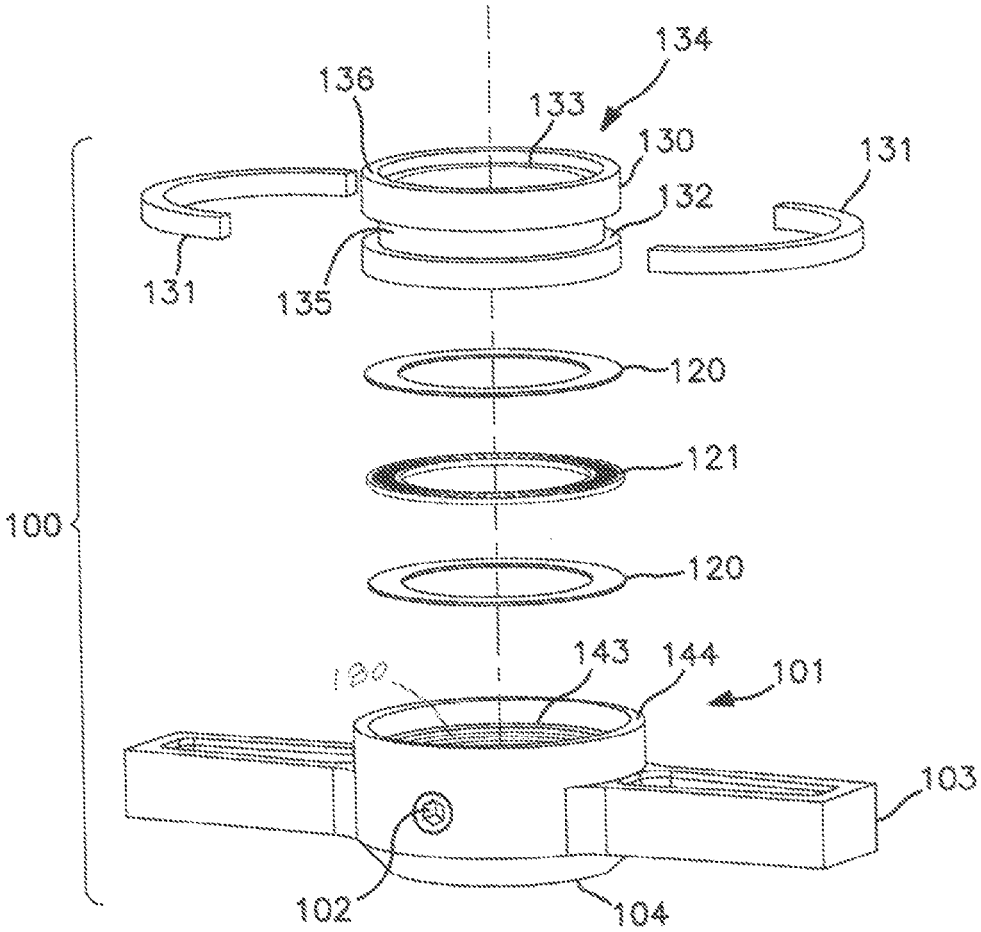
FIG. 1 is an exploded diagram illustrating one embodiment of the present general inventive concept.

FIG. 1 illustrates one exemplary embodiment of the tightening assembly 100. The illustration shows the tightening assembly 100 both inverted and exploded, for ease of understanding the overall structure as well as the components that are unseen when the assembly is together and/or in use. As illustrated in FIG. 1, nut 101 can include at least one wing 103, a tapered lip 104, an opening 102, a rim 144, and a recessed lip 143. In some embodiments, the interior of nut 101 is threaded 180. Optional wing(s) 103 on nut 101 can allow for grip and ease of use when tightening or loosening nut 101. When in use, nut 101 is inverted relative to the view of FIG. 1 (see, e.g., FIG. 2), thus tapered lip 104 provides a sloped surface to enhance safety features of the present inventive concept. Opening 102 is provided for optionally locking nut 101 into place when in use. In some embodiments, a set screw (not shown) is inserted into opening 102 to facilitate optional locking of nut 101 relative to movement up or down core 201 (see FIG. 2).

Continuing with FIG. 1, recessed lip 143 within the interior surface of nut 101 serves as a platform upon which the other components of tightening assembly 100 are stacked, starting with at least one flat washer 120. At least one flat washer 120 is inserted within nut 101 so as to rest upon recessed lip 143. Roller bearing 121 is then placed so as to rest upon flat washer 120. Another flat washer 120 is then stacked upon roller bearing 121.

As also illustrated in FIG. 1, rotator 134 has an upper end 132, a lower end 130, and a recessed exterior midsection 135, recessed interior midsection 133, and a rim 136. At least two split rings 131 can be placed around the exterior surface of recessed exterior midsection 133 so as to encircle recessed exterior midsection 133. The rotator 134 with at least two split rings 131 is then placed within nut recessed lip 143 so as to sit on top of second flat washer 120 which lies atop roller bearing 121, lying atop first flat washer 120 and within recessed lip 143 of nut 101. In some embodiments, the at least two split rings 131 are then fixedly attached to rim 144 of nut 101, such as, in some embodiments, by welding. Thus fixedly attached, split rings 131 and nut 101 move as one unit, while rotator 134, second flat washer 120, roller bearing 121, and first flat washer 120—though housed within and "floating" between fixedly attached split rings 131 and nut 101—remain unattached and able to move freely within the relative horizontal plane. At the lower end 130 of rotator 134, recessed interior midsection 133 will, when in use, serve as the point of contact with a base rod 200—specifically, at the upper end 210 of base rod 200 (see FIG. 2). Once base rod 200 is inserted to the point of contact with recessed interior midsection 133, rim 136 of rotator 134 provides a surface for fixedly attaching base 200 to rim 136. In some embodiments, fixed attachment between base 200 and rim 136 is achieved by welding. Thus fixedly attached, base 200 and rotator 134 move as one unit, while second flat washer 120, roller bearing 121, and first flat washer 120—now securely housed between nut 101 and rotator 134—remain unattached and able to move freely within the relative horizontal plane. In this and similar configurations, then, second flat washer 120, roller bearing 121, and first flat washer 120 provide a means to enhance the operational qualities of nut 101 and the apparatus as a whole while reducing friction and wear.

Figure 2:
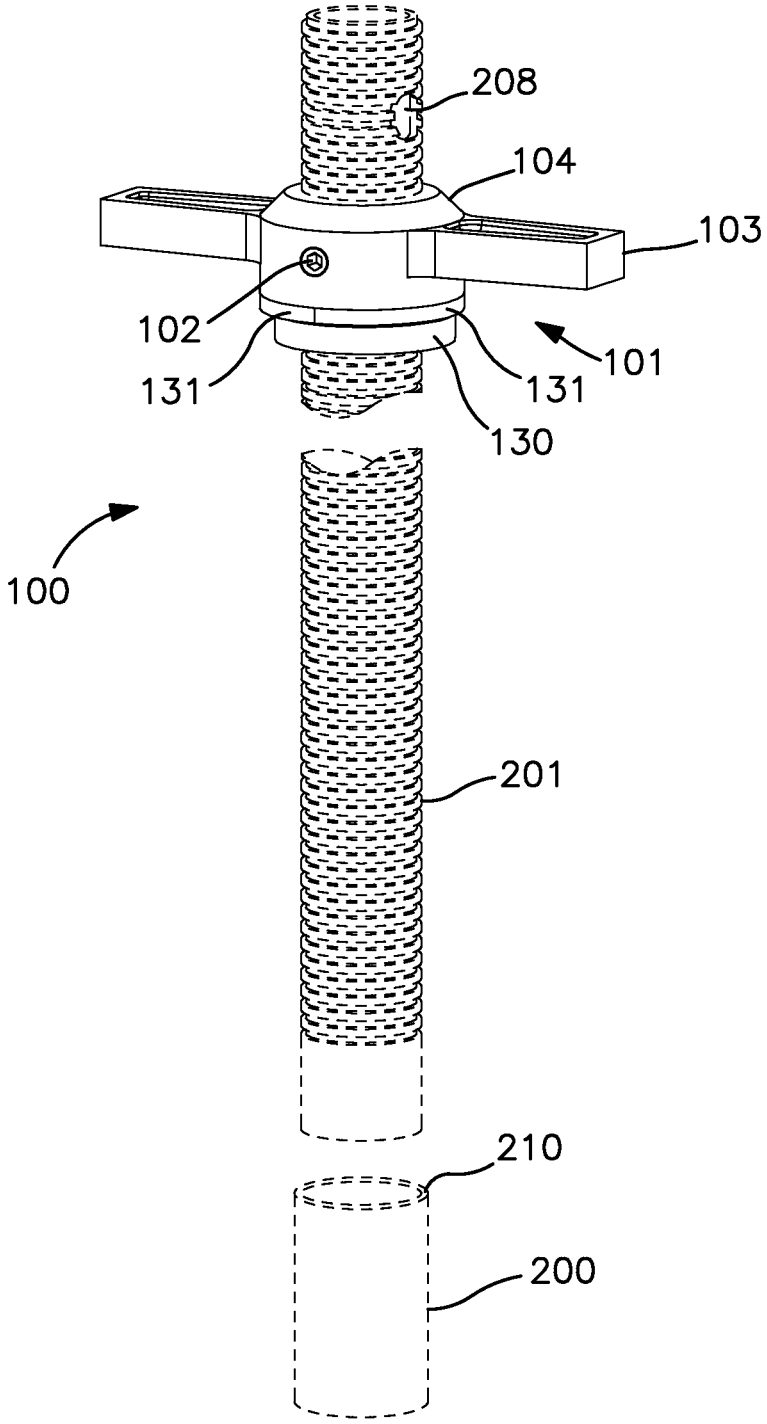
FIG. 2 is a diagram illustrating another embodiment of the present general inventive concept.

As shown in FIG. 2, base rod 200 is shown in partial view; also illustrated in partial view is core rod 201. In some exemplary embodiments, the exterior surface of core 201 is threaded as shown to provide for precise, incremental extension or retraction of core 201 within base 200. Optimally, the threading of core 201 correlates with the threading 180 (see FIG. 1) within nut 101. Optionally, core 201 can have hole 208 through-bored therein, for attaching an optional top plate assembly 360 (see, e.g., FIG. 3). Tightening assembly 100 is shown in its correct orientation in FIG. 2, including tapered lip 104 of nut 101, optional wing(s) 103 of nut 101, optional hole 102 within nut 101, at least two split rings 131 encircling the midsection (not visible) of rotator 134, and lower end 130 of rotator 134. Also not visible are first flat washer 120, roller bearing 121, and second flat washer 120, all contained within nut 101. When in use, the tightening assembly is rotated along the core 201 via the threaded surface to raise or lower core 201 as desired within base 200. Lower end 130 of rotator 134 is defined to have a diameter sufficient to oversit the upper end 210 of base 200, such that recessed midsection 132 (not visible) of rotator 134 will be in direct contact with upper end 210 of base 200. Rim 136 (see FIG. 1) serves as a point of fixed attachment to upper end 210 of base 200, as discussed above.

Figure 3:
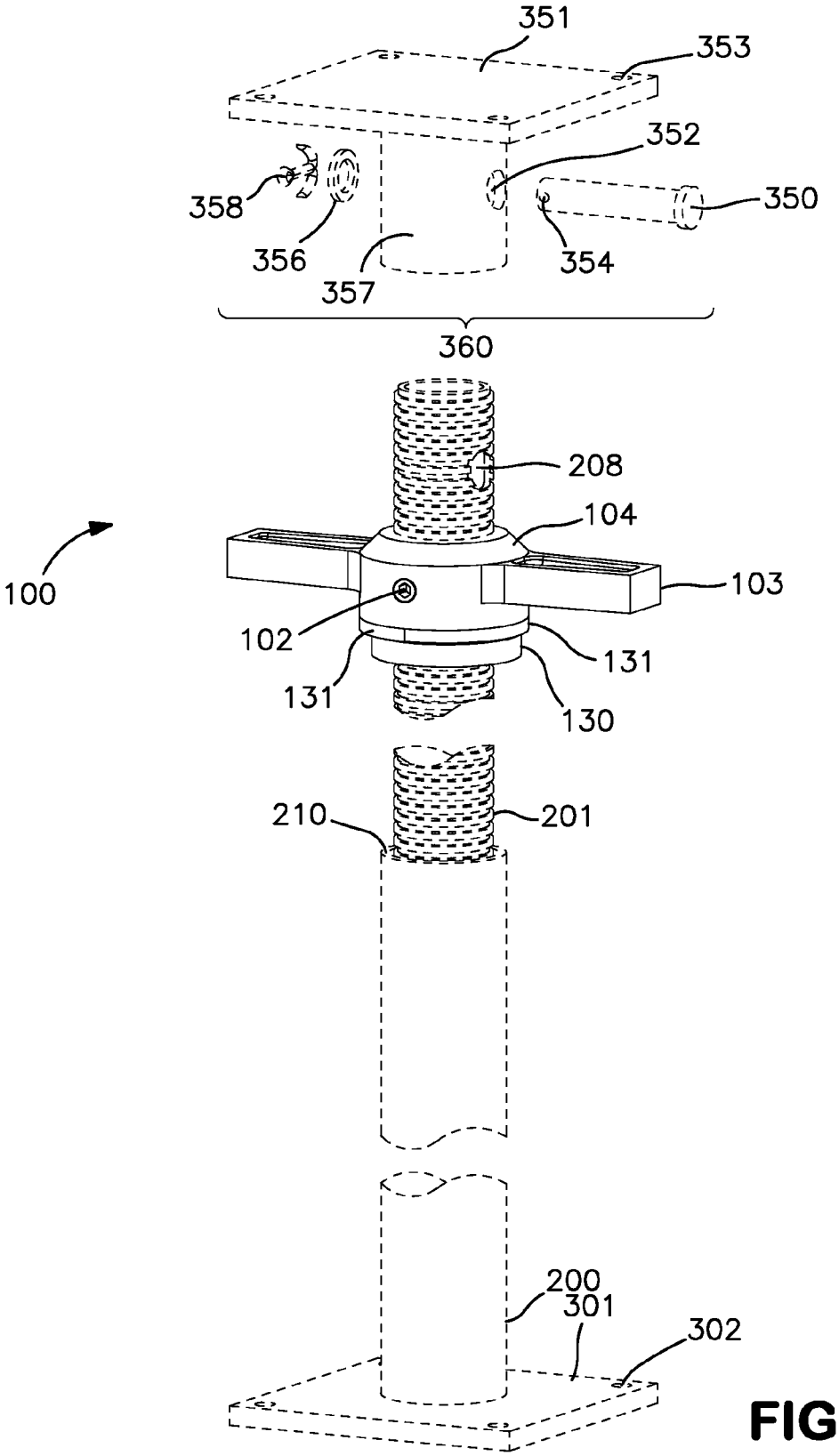
FIG. 3 is a diagram illustrating another embodiment of the present general inventive concept, including optional base plate and top plate.

FIG. 3 illustrates the present general inventive concept with an optional base plate 301 attached to base 200, and optional hole(s) 302 through-bored through optional base plate 301 for securing the apparatus if desired. For embodiments utilizing base plate 301, fixed attachment of base plate 301 to base 200 is preferred, such as, for one example, via welding.

Similarly illustrated in FIG. 3, core 201 can have an optional top plate assembly 360 attached, for example, via hole 208 in core 201. Optional top plate assembly 360 can include top plate 351 with, optionally, hole(s) 353 through-bored through top plate 351 for securing the apparatus if desired. Top plate 351 can be fixedly attached to collar 357, such as, for one example, via welding. Collar 357 could include at least two holes 352, through-bored so as to be in alignment one with the other across collar 357. To removeably attach optional top plate assembly 360 to core 201, first, set top plate assembly 351 on the upper end of core 201 and align holes 352 with hole 208. Next, insert a means of attachment, such as, for one example, a clevis pin 350 which would include through-bored hole 354 to accommodate a means of removeably securing pin 350 through holes 352 and hole 208. One example of such means of removeably securing pin 350 could be a cotter pin 358. Optional flat washer 356 can be inserted between collar 357 and cotter pin 358 so as to encircle pin 350, for ease of removing cotter pin 358 when detachment of top plate assembly 360 from core 201 is desired. Alternatively, top plate 351 can be fixedly attached to core 201, by, for one example, welding.

Figure 4:
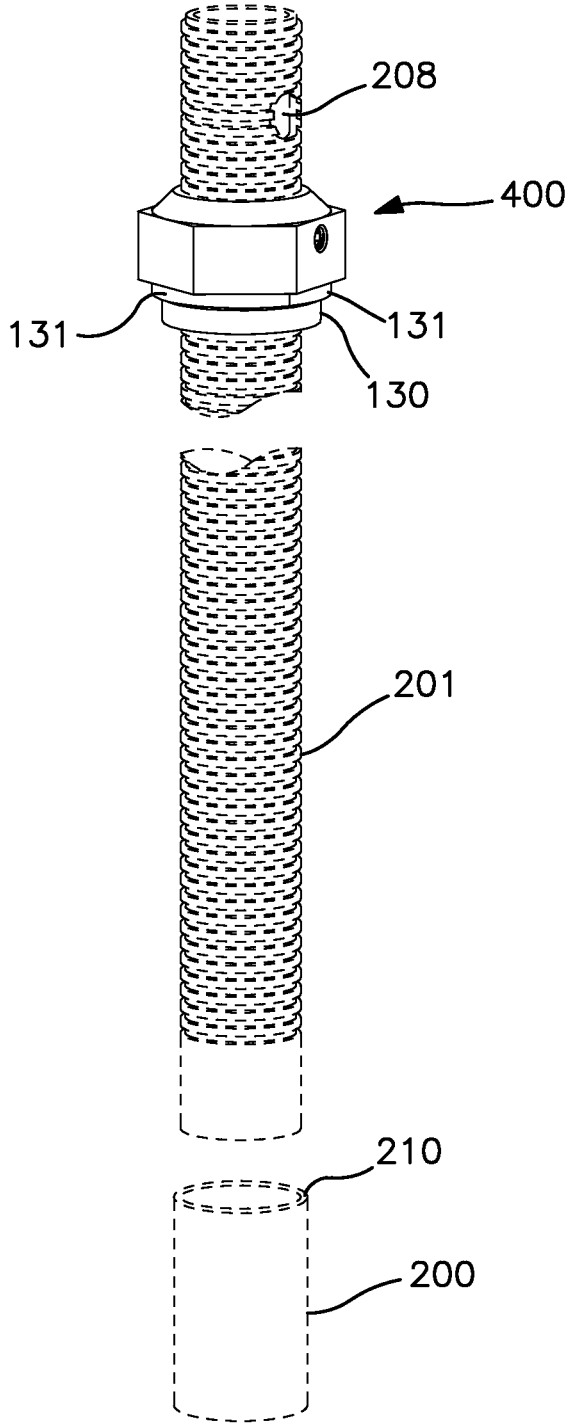
FIG. 4 is a diagram illustrating another embodiment of the present general inventive concept.

FIG. 4 illustrates another embodiment of the present general inventive concept. In this and similar embodiments, nut 101 has been replaced by alternative nut 400, which is functionally identical in all respects to nut 101 except nut 400 is manipulated via gripping on multiple sides instead of via optional wing(s) 103. In some embodiments, nut 400 is a hex nut, having six sides. All other structural components and aspects and functional aspects of the present general inventive concept are identical to those described above.

Figure 5:
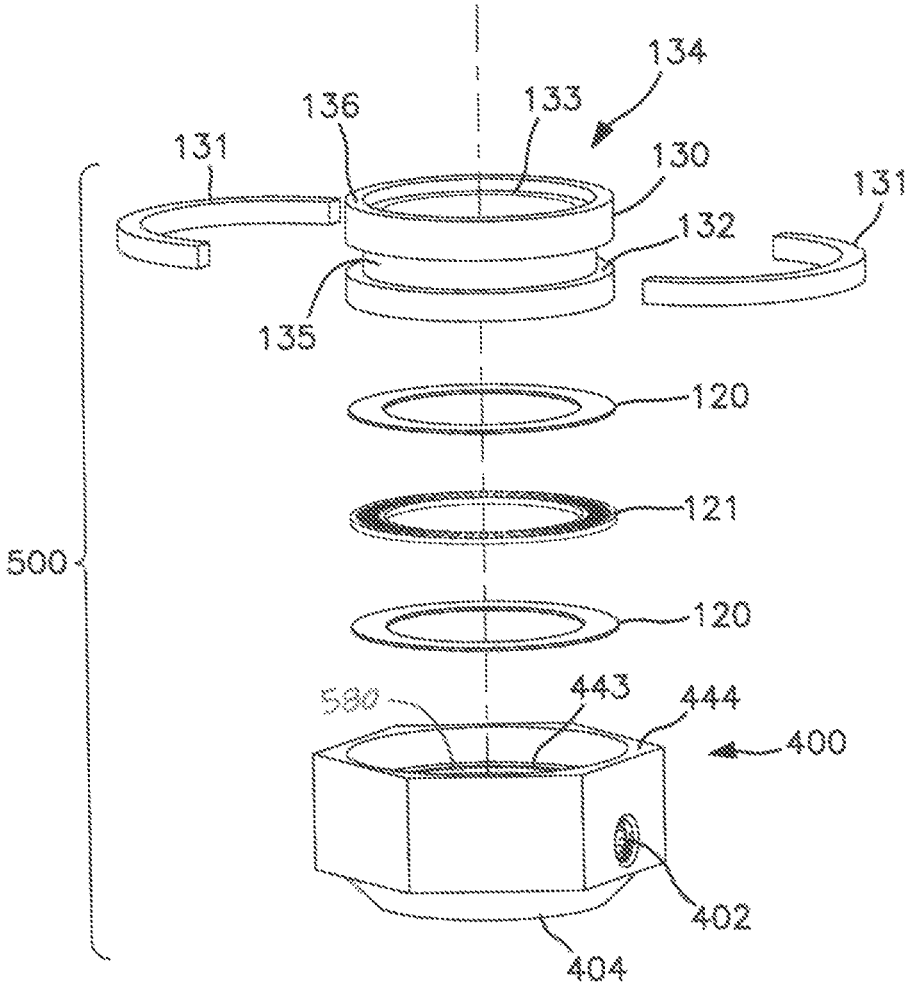
FIG. 5 is an exploded diagram illustrating another embodiment of the present general inventive concept.

FIG. 5 illustrates an inverted, exploded view of tightening assembly 500, illustrating nut 400. Here, nut 400 includes tapered lip 404 and optional hole 402 for locking, if desired, as described previously, as well as threading 580. Also shown in FIG. 5 are recessed lip 443, upon which first flat washer 120 would rest, there to have roller bearing 121 stacked upon first flat washer 120, followed by second flat washer 120 stacked atop roller bearing 121. Rim 444 provides the point of fixed attachment of nut 400 to split ring(s) 131, thus allowing tightening assembly 500 to contact base 200 (see FIG. 4) at upper end 210 of base 200. Split ring(s) 131 and rotator 134 are assembled and operate as described above.

Figure 6:
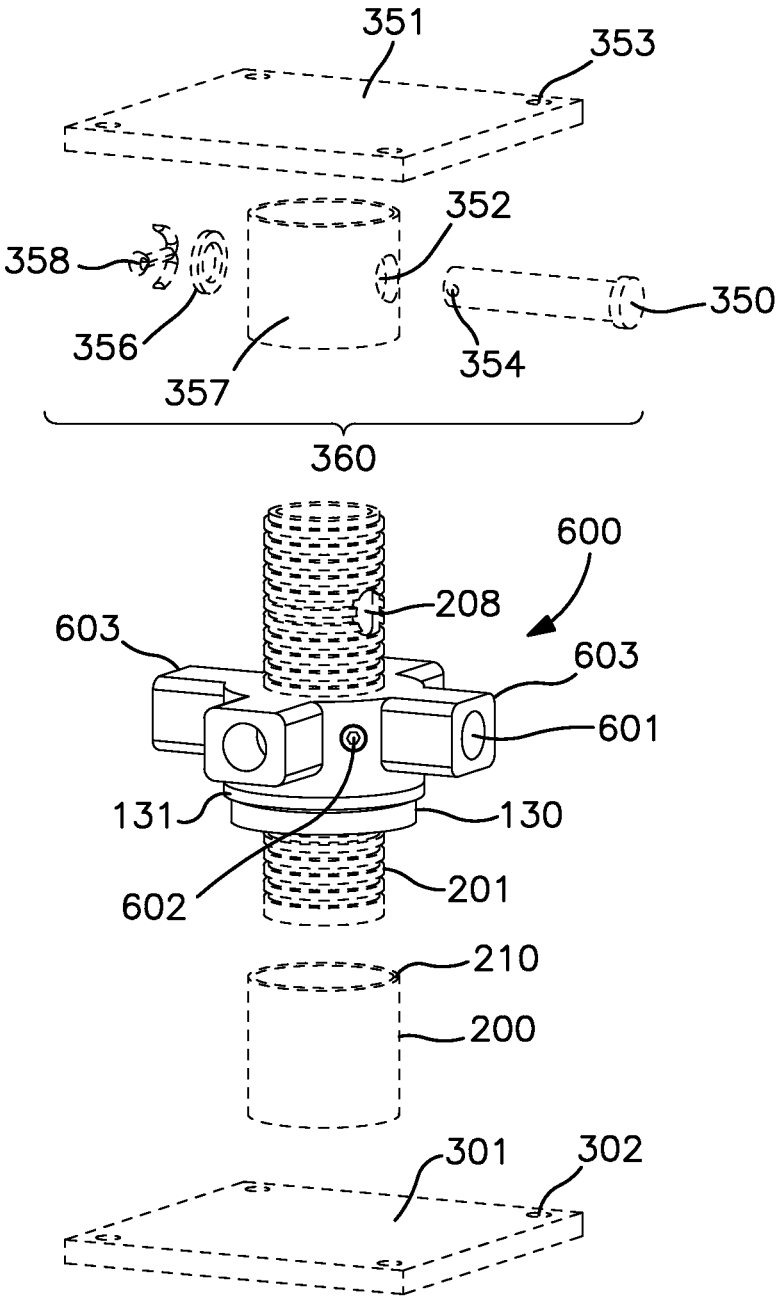
FIG. 6 is a diagram illustrating another embodiment of the present general inventive concept.

FIG. 6 illustrates another embodiment of the present general inventive concept. In this and similar embodiments, nut 101 has been replaced by alternative nut 600, which is functionally identical in all respects to nut 101 except nut 600 is a capstan nut, with at least one protrusion 603 from nut 600. Each protrusion 603 has defined therein a hole 601. Tightening or loosening of nut 600 can be achieved by inserting a means of leverage with diameter proportional to hole 601 and thus rotating nut 600 as desired to extend/raise or retract/lower core 201. In some embodiments, nut 600 is a quad-capstan nut, having four protrusions 603. All other structural components and aspects and functional aspects of the present general inventive concept are identical to those described above.

Figure 7:
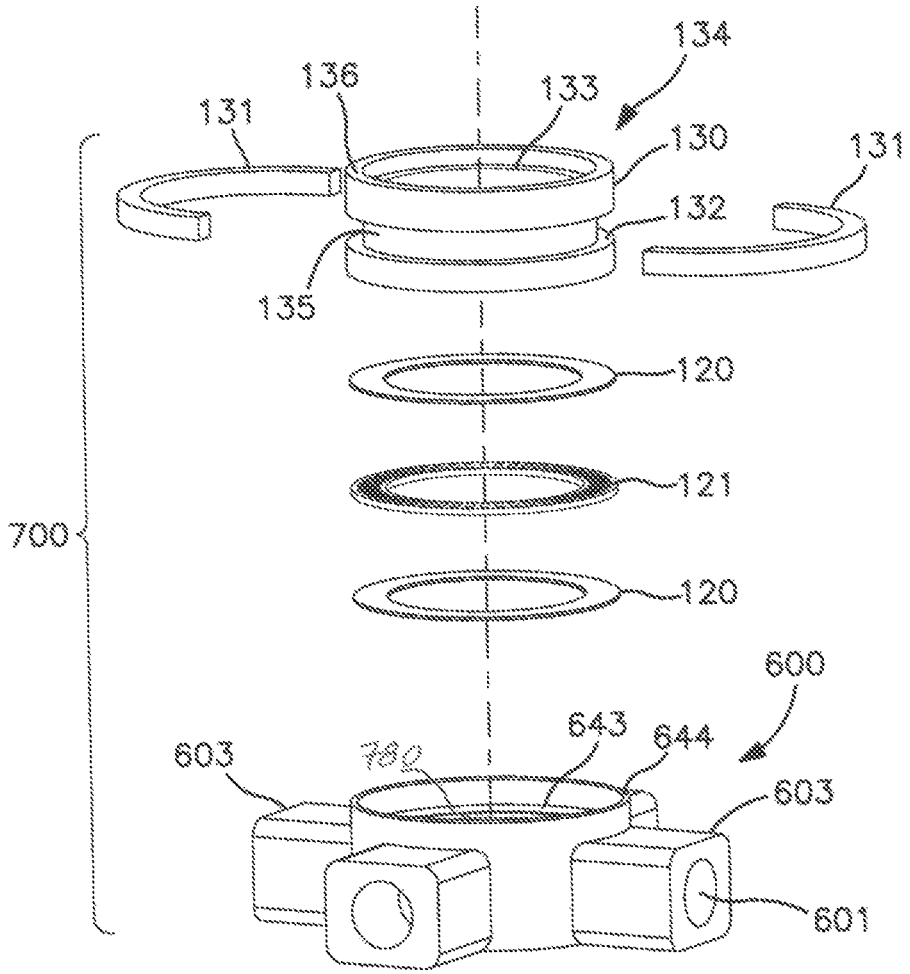
FIG. 7 is an exploded diagram illustrating another embodiment of the present general inventive concept.

FIG. 7 illustrates an inverted, exploded view of tightening assembly 700, illustrating nut 600, which includes interior threading 780. Here, nut 600 includes at least one protrusion 603 with each protrusion 603 containing therein hole 601, upper rim 644, and recessed lip 643, as well as optional hole 602 (see FIG. 6) for locking, if desired. In this and similar embodiments, recessed lip 643 serves as a platform upon which first flat washer 120 would rest, there to have roller bearing 121 stacked upon first flat washer 120, followed by second flat washer 120 stacked atop roller bearing 121. Rim 644 provides the point of fixed attachment of nut 600 to split ring(s) 131, thus allowing tightening assembly 700 to contact base 200 (see FIG. 4) at upper end 210 of base 200. Split ring(s) 131 and rotator 134 are assembled and operate as described above.

While the present general inventive concept has been illustrated by description of some embodiments, and while the illustrative embodiments have been described in detail, it is not the intention of the applicant to restrict or in any way limit the scope of the appended claims to such detail. Additional modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

It is also noted that numerous variations, modifications, and additional embodiments are possible, and, accordingly, all such variations, modifications, and embodiments are to be regarded as being within the spirit and scope of the present general inventive concept. For example, regardless of the content of any portion of this application, unless clearly specified to the contrary, there is no requirement for the inclusion in any claim herein or of any application claiming priority hereto of any particular described or illustrated activity or element, any particular sequence of such activities, or any particular interrelationship of such elements. Moreover, any activity can be repeated, any activity can be performed by multiple entities, and/or any element can be duplicated. Accordingly, while the present general inventive concept has been illustrated by description of several embodiments, it is not the intention of the applicant to restrict or in any way limit the scope of the inventive concept to such descriptions and illustrations. Instead, the descriptions, drawings, and claims herein are to be regarded as illustrative in nature, and not as restrictive, and additional embodiments will readily appear to those skilled in the art upon reading the above description and drawings.

What is claimed is:

1. A shoring apparatus with roller bearing, said shoring apparatus comprised of:

a base, said base being of an overall cylindrical rod shape, said base further having defined thereon an upper terminal end, a lower terminal end, an outer surface, an inner surface, and a void space within for receiving a core;

a core, said core being of an overall cylindrical rod shape, said core further having defined thereon an upper terminal end, a lower terminal end, and an outer surface, said outer surface being of such dimension so as to be releasably secured within said void space to said inner surface of said base; and a tightening assembly for restricting movement of said core relative to said inner surface of said base and within said void space of said base, said tightening assembly comprising at least one nut, at least one flat washer, at least two split rings, at least one roller bearing, and at least one rotator, said rotator being defined to have an upper end, a midsection and a lower end.

2. The shoring apparatus of claim 1, said outer surface of said core having threading defined thereon, and said at least one nut of said tightening assembly having threading defined therein so as to match said threading of said core to provide for incrementally extending or incrementally retracting said core within said base.

3. The shoring apparatus of claim 1, said upper end of said at least one rotator being of complementary diameter to said at least one nut so as to provide a close-tolerance fit to said at least one nut while concurrently providing for free rotation of said at least one nut around said upper end of said at least one rotator.

4. The shoring apparatus of claim 1, said midsection of said at least one rotator being further defined so as to provide close-tolerance fit of said at least two split rings around said midsection of said at least one rotator.

5. The shoring apparatus of claim 1, said lower end of said at least one rotator being of sufficient diameter so as to provide a platform surface such that said tightening assembly rests upon said upper terminal end of said base.

6. The shoring apparatus as in any of the preceding claims, in which said lower terminal end of said base has attached thereon a base plate.

* * * * *